US008128287B2

(12) United States Patent
Song et al.

(10) Patent No.: US 8,128,287 B2
(45) Date of Patent: Mar. 6, 2012

(54) STORAGE BAG

(76) Inventors: David Song, Anaheim, CA (US); Huy John Ba Vu, Fullerton, CA (US)

( * ) Notice: Subject to any disclaimer, the term of this patent is extended or adjusted under 35 U.S.C. 154(b) by 1036 days.

(21) Appl. No.: 12/027,261

(22) Filed: Feb. 6, 2008

(65) Prior Publication Data

US 2009/0196534 A1 Aug. 6, 2009

(51) Int. Cl.

| | |
|---|---|
| ***B65D 30/00*** | (2006.01) |
| ***B65D 30/22*** | (2006.01) |
| ***B65D 33/16*** | (2006.01) |
| ***B65D 30/08*** | (2006.01) |
| ***A01K 29/00*** | (2006.01) |
| ***B65G 7/12*** | (2006.01) |

(52) U.S. Cl. ..... 383/4; 383/38; 383/37; 383/63; 383/65; 383/111; 294/1.3; 294/25

(58) Field of Classification Search ..... 383/38, 383/4, 63, 111, 65; 294/1.3, 25; 119/161, 119/867

See application file for complete search history.

(56) References Cited

U.S. PATENT DOCUMENTS

| | | | | |
|---|---|---|---|---|
| 2,795,806 | A * | 6/1957 | Suttles | 401/7 |
| 4,677,697 | A * | 7/1987 | Hayes | 2/159 |
| 5,070,584 | A | 12/1991 | Dais et al. | |
| 5,174,658 | A | 12/1992 | Cook et al. | |
| 5,301,806 | A * | 4/1994 | Olson | 206/278 |
| 5,704,670 | A * | 1/1998 | Surplus | 294/25 |
| 5,862,944 | A * | 1/1999 | Scherr | 221/63 |
| 5,878,438 | A * | 3/1999 | Ragsdale | 2/158 |
| 5,961,167 | A * | 10/1999 | Gilley | 294/1.3 |
| 6,116,668 | A * | 9/2000 | Carpol | 294/1.3 |
| 6,203,080 | B1 * | 3/2001 | Surplus | 294/1.3 |
| 6,237,971 | B1 * | 5/2001 | Ward Gilley | 294/1.3 |
| 6,511,111 | B2 * | 1/2003 | Dooley | 294/1.3 |
| 6,539,549 | B1 * | 4/2003 | Peters, Jr. | 2/16 |
| 6,824,640 | B2 * | 11/2004 | Brockman | 156/251 |
| 6,899,460 | B2 | 5/2005 | Turvey et al. | |
| 7,300,207 | B2 * | 11/2007 | Linneweil | 383/35 |
| 2003/0223655 | A1 * | 12/2003 | Faygenov | 383/63 |
| 2005/0137073 | A1 * | 6/2005 | Weaver | 493/394 |
| 2006/0171608 | A1 * | 8/2006 | Goodman | 383/41 |

* cited by examiner

*Primary Examiner* — Nathan J Newhouse
*Assistant Examiner* — Latrice Byrd
(74) *Attorney, Agent, or Firm* — Loza & Loza LLP; Heidi L. Eisenhut

(57) ABSTRACT

The present invention provides a reclosable storage bag for packaging/containing and transporting objects, such as food. The reclosable storage bag may include a flexible inner liner contoured to the shape of a user's hand and have one or more closure members for sealing the ends of the bag. The user may store food in an interior storage area of the bag and may use the flexible inner liner to grab or hold onto the food so that the user will not have to directly touch the food while eating.

19 Claims, 6 Drawing Sheets

STORAGE BAG

FIELD

The present invention relates to storage bags, in particular, to reclosable storage bags having an inner liner adapted to receive a user's hand.

BACKGROUND

Clear plastic storage bags may be used for containing/packaging and transporting foods, produce, powders, ice, chemicals, waste, etc. One typical use of storage bags is for a packed meal, such as lunch. A packed meal is a meal typically prepared at home and carried to be eaten somewhere else, such as school, a workplace or at an outing, such as a picnic. When the packed meal is to be eaten, the user removes the food from the storage bag with his hands. However, as the meal is to be eaten away from home, it is unlikely that the user will have the opportunity to follow proper hygiene and as a result eats the food with contaminated hands. This is especially true for workers who do not work in an office setting, such as construction workers.

Hands may become contaminated in many ways, such as using the toilet, changing a diaper, tending to someone who is sick and handling or cooking food, especially handling raw meat, fish or poultry. Furthermore, touching just about anything in public, such as phones, handrails, doorknobs, steering wheels, etc., will also contaminate the hands. However, it is not always possible for a person to wash his hands after any of these events and/or prior to eating. As a result, users end up having to touch their food with their dirty/contaminated hands before putting it in their mouth.

Consequently, a reclosable storage bag for containing/packaging and transporting food that also allows a user to safely eat his food with dirty/contaminated hands is needed.

SUMMARY OF THE PRESENT INVENTION

In one embodiment, a storage bag for containing/packaging items, such as food, is provided. The storage bag may include a first flexible panel having a first pair of side peripheral edges, a first top edge and a first bottom edge superimposed on a second flexible panel, having a second pair of side peripheral edges, a second top edge and a second bottom edge. The first and second flexible panels may be sealed together along the first and second side peripheral edges creating an interior storage area for storing the items. A flexible inner liner may be secured to the first and second bottom edges and located in the interior storage area.

In another embodiment, the storage bag may also include a top closure member. The top closure member may have a male profile strip, proximate the first top edge, and a female profile strip, proximate the second top edge, adapted to interlock, for securing the first and second top edges of the first and second flexible panels together. To assist users in opening the bag, the bag may also include a pair of tabs below the top closure member. When a user pulls the tabs in opposite directions, the closure member is opened or disengaged allowing the user access to the interior storage area and its contents. The storage bag may also include a bottom closer member for retaining the flexible inner liner in the interior storage area when not in use.

In another embodiment, the flexible inner liner may be contoured to the shape of a hand and include a plurality of extending members. The plurality of extending members may include a thumb portion, index finger portion, middle finger portion, ring finger portion and little finger which extend outwardly from the main portion and are adapted to receive the thumb, index finger, middle finger, ring finger and little finger, respectively, of the hand of a user in a conventional manner.

In another embodiment, the storage bag may also include a pouch in the interior storage area for separating stored items. The pouch may be comprised of one or more flexible sheets secured to either the first or second flexible panel. A closure member may be used for sealing the pouch.

The foregoing, together with other features and advantages of the present invention, will become more apparent when referring to the following specification, claims and accompanying drawings.

BRIEF DESCRIPTION OF THE DRAWINGS

Various features of the present invention will be better understood from the following detailed description of an exemplary embodiment of the invention, taken in conjunction with the accompanying drawings in which like reference numerals refer to like parts.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

In the following description, certain terminology is used to describe certain features of one or more embodiments of the invention. The term "food" refers to any type of edible substance including all types of fruits and vegetables.

One aspect of the present invention provides a reclosable storage bag for packaging/containing and transporting objects, such as food. The reclosable storage bag may include a flexible inner liner contoured to the shape of a user's hand and have one or more closure members for sealing the ends of the bag. The user may store food in an interior storage area of the bag and may use the flexible inner liner to grab or hold onto the food so that the user will not have to directly touch the food while eating.

In one embodiment, the bag may be clear, opaque or colored. Additionally, the bag may include pictures or a design so that the user, especially a child, may use the bag as a puppet after eating.

Figure 1:
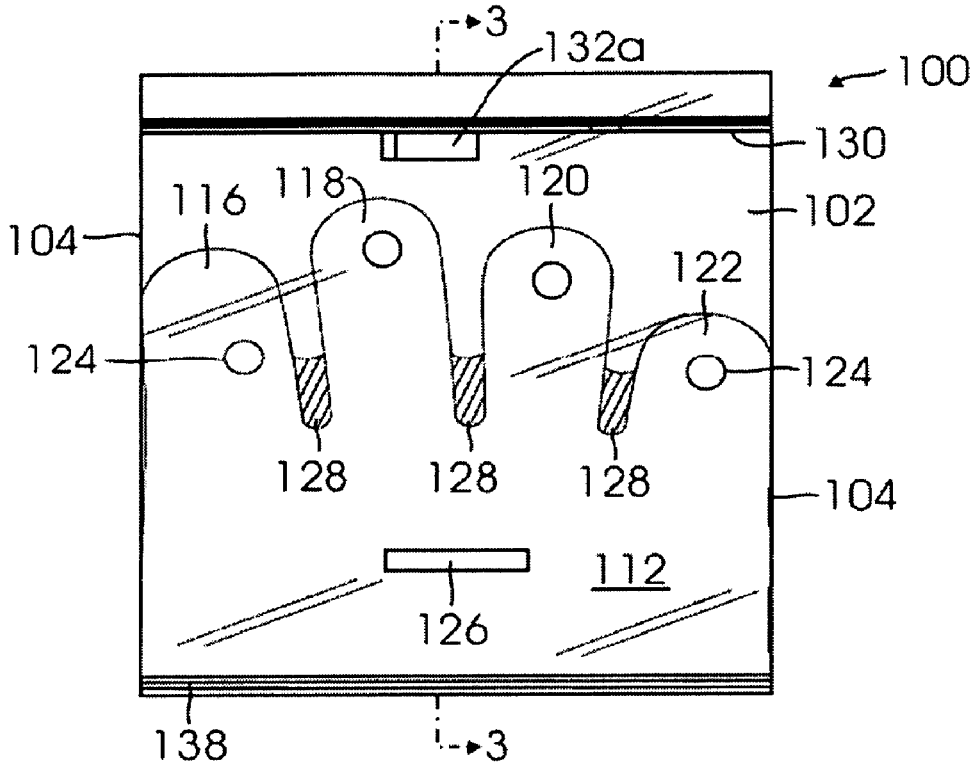
FIG. 1 illustrates a front view of a storage bag, according to one embodiment of the present invention.
Figure 2:
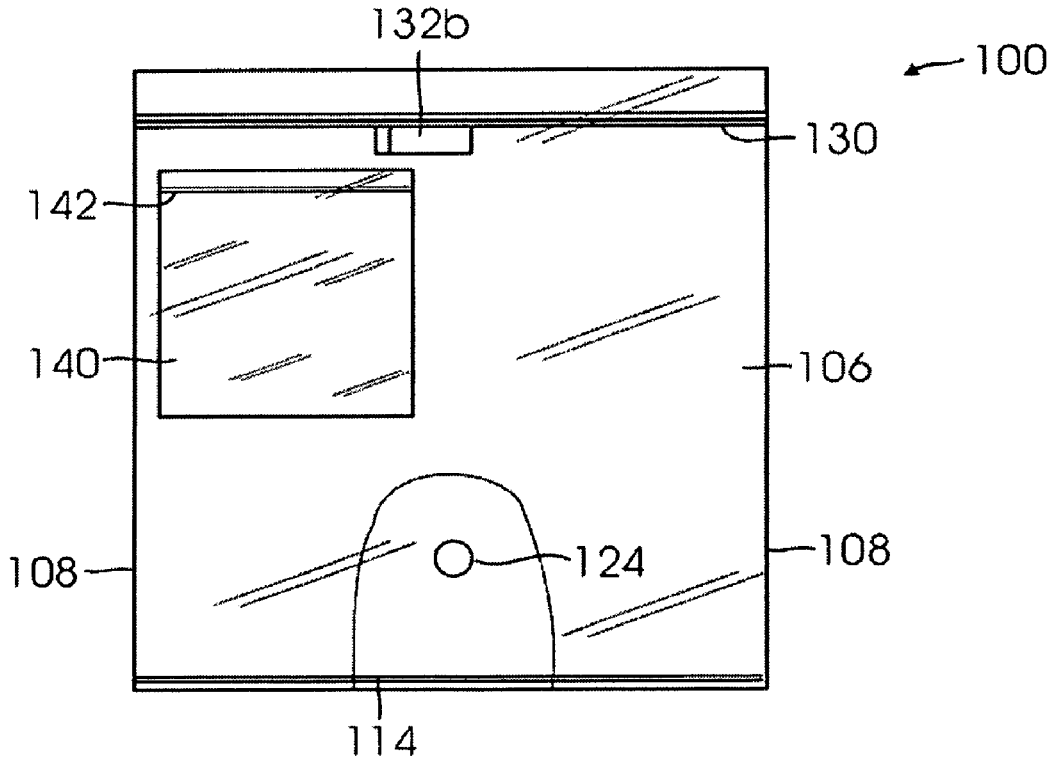
FIG. 2 illustrates a back view of the storage bag of FIG. 1.

FIGS. 1 and 2 illustrate front and back views of a reclosable storage bag 100, according to one embodiment of the present invention. The storage bag 100 includes a first flexible panel 102, having a first pair of side peripheral edges 104, a first top edge and a first bottom edge, superimposed on a second flexible panel 106, having a second pair of side peripheral edges 108, a second top edge and a second bottom edge, and sealed together along the first and second side peripheral edges 104 and 108 creating an interior storage area. The flexible panels 102 and 106 may be heat-sealed together, or sealed together by any other method known in the art.

The storage bag 100 may further include a flexible inner liner 110 (FIG. 4), secured to the first and second bottom edges of the panels 102 and 106, and located within the interior storage area. The flexible inner liner 110 may have a main portion 112 into which a hand of a user may be inserted. The flexible inner liner 110 may be contoured to the shape of a hand and include a plurality of extending members. The plurality of extending members may include a thumb portion 114, index finger portion 116, middle finger portion 118, ring finger portion 120 and little finger 122 which extend outwardly from the main portion 112 and are adapted to receive the thumb, index finger, middle finger, ring finger and little finger, respectively, of the user's hand in a conventional manner.

In one embodiment, the thumb portion 114 may be secured to an inner side of the second flexible panel 106 and the index finger, middle finger, ring finger and little finger portions 116-122 may be secured to an inner side of the first flexible panel 106 by any method known in the art, such as a set of heat stamps 124. The set of heat stamps 124 may be used to keep the extending members of the inner liner out of the way when items are placed in the bag. However, once a user inserts his hand into the flexible inner liner 110 of the bag 100, the set of heat stamps 124 may be detached from the flexible side panels 104 and 108 to allow the user to pull the flexible panels 102 and 106 downwards so that the user may easily access the contents of the bag 100. The set of heat stamps 124 may be generally circular in shape. However, in alternative embodiments, the set heat stamps may be other shapes, such as ovals, triangles, squares, or other polygons.

In one embodiment, the main portion 112 of the flexible inner liner 110 may be secured to the flexible panels 104 and 106 by a heat stamp 126 to retain the flexible inner liner 110 within the interior storage area when the user removes his hand from the flexible inner liner 110. The flexible inner liner 110 allows a user to easily pick up an object, such as food, without contaminating the object with dirty hands as the flexible inner liner 110 acts as a barrier between the food and the hands of the user. The heat stamp 126 may be generally rectangular in shape. However, in alternative embodiments, the heat stamp may be other shapes, such as ovals, triangles, squares, or other polygons. The heat stamp 126 may be used to attach the flexible inner liner 110 to the first flexible panel 102 and/or the second flexible panel 106.

The storage bag 100 may include a plurality of connecting members 128 located between the finger portions 116-122. The plurality of connecting members 128 may be used to interconnect and strengthen the finger portions 116-122.

The bag 100 may include a closure member 130 for securing the first and second top edges of the first and second flexible panels 102 and 106 together to keep the objects in the bag 100. The closure member 130 may include interlocking male and female profile strips secured near the top inner edges of the flexible panels 102 and 106. The mate and female profile strips may be extruded separately and subsequently attached to the respective flexible panels 102 and 106 near the top edges or the male and female profile strips may be extruded integral with the flexible panels 102 and 106. The closure member 130 may be any other type of closure mechanism known in the art.

The storage bag 100 may further include a pair of tabs 132*a* and 132*b* secured to the outer sides of the flexible panels 102 and 104, below the closure member 130, for assisting users who may have difficulty in opening the storage bag 100, such as users with arthritis. When a user pulls the tabs 132*a* and 132*b* in opposite directions, the closure member 130 of the storage bag 100 is opened or disengaged allowing the user access to the interior storage area and its contents.

The storage bag 100 may also include a bottom or second closure member 138 for securing the first and second bottom edges of the first and second flexible panels 102 and 106 together to retain the entire inner liner 110 in the interior storage area. The second closure member 138 may include interlocking male and female profile strips which may be secured near the inner bottom edges of the flexible panels 102 and 106. The male and female profile strips may be extruded separately and subsequently attached to the respective flexible panels 102 and 106 or the male and female profile strips may be extruded integral with the flexible panels 102 and 106. Alternatively, the second closure member 138 may be any other type of closing mechanism known in the art.

The storage bag 100 may further include a pouch 140 secured to one of the flexible panels for separating items within the bag 100. The pouch 140 may be comprised of one or more flexible sheets secured to either the first or second flexible panel. The pouch 140 may be heat sealed to the flexible panel or may be secured by any method known in the art. A third closure member 142 may be used for sealing the pouch 140. The third closure member 142 may include interlocking male and female profile strips for sealing the pouch 140. The profile strips may be extruded on top of the flexible sheet and panel or may be extruded integral with the flexible sheet and panel.

The pouch 140 may be used to store dip to be eaten with another type of food, such as vegetables, stored in the interior storage area of the bag 100. The pouch 140 may also be used to store a napkin to be used after the user has eaten the food in the interior storage area.

Figure 3:
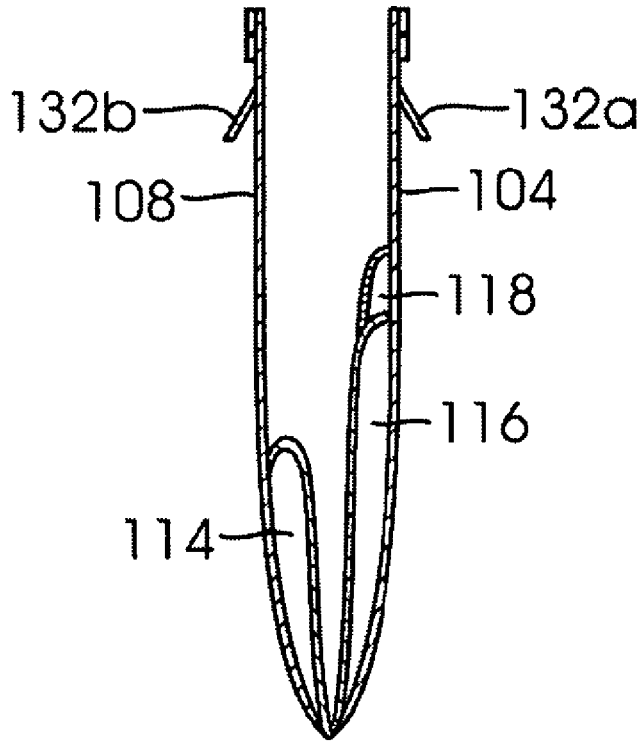
FIG. 3 illustrates a cross-sectional side view of the storage bag of FIG. 1, taken along line 3-3.
Figure 4:
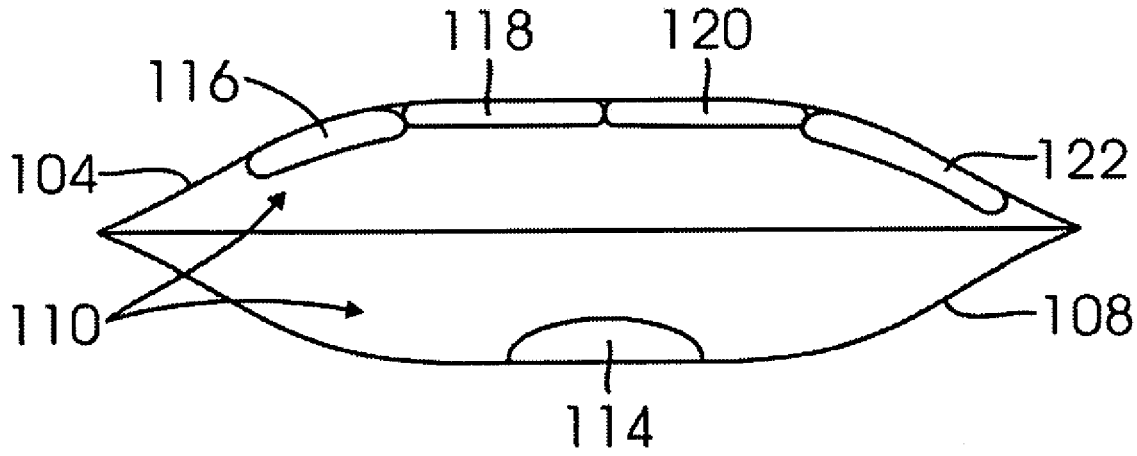
FIG. 4 illustrates a bottom view of the storage bag of FIG. 1 in an open position.

FIG. 3 illustrates a cross-sectional side view of the storage bag 100 of FIG. 1 taken along line 3-3. FIG. 4 illustrates a bottom view of the storage bag 100 of FIG. 1 in an open position.

Figure 5:
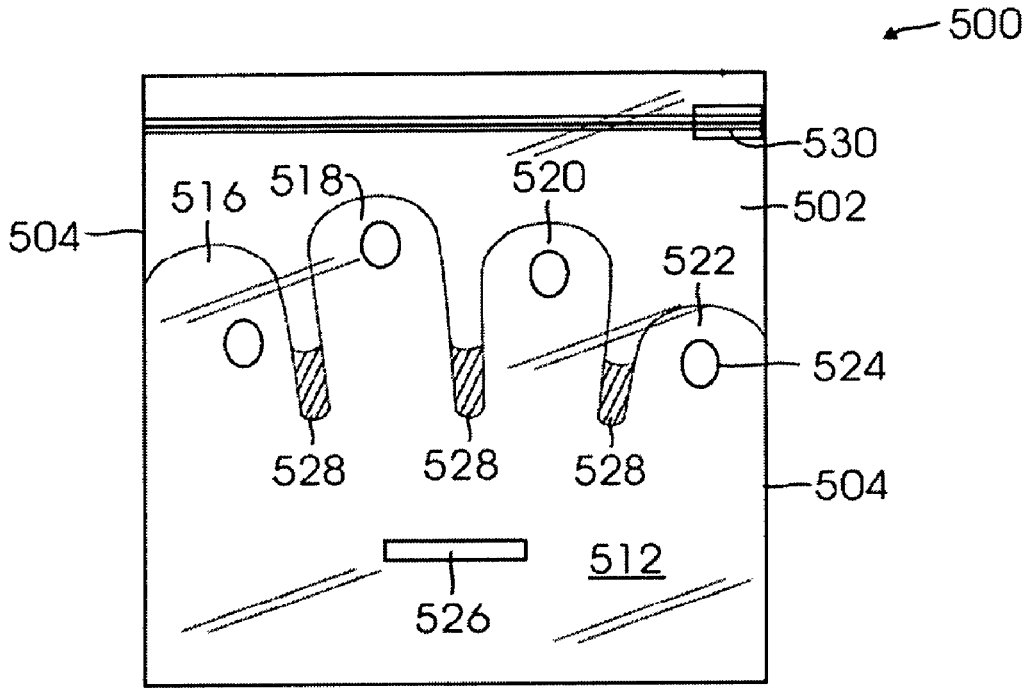
FIG. 5 illustrates a front view of a storage bag, according to one embodiment of the present invention.
Figure 6:
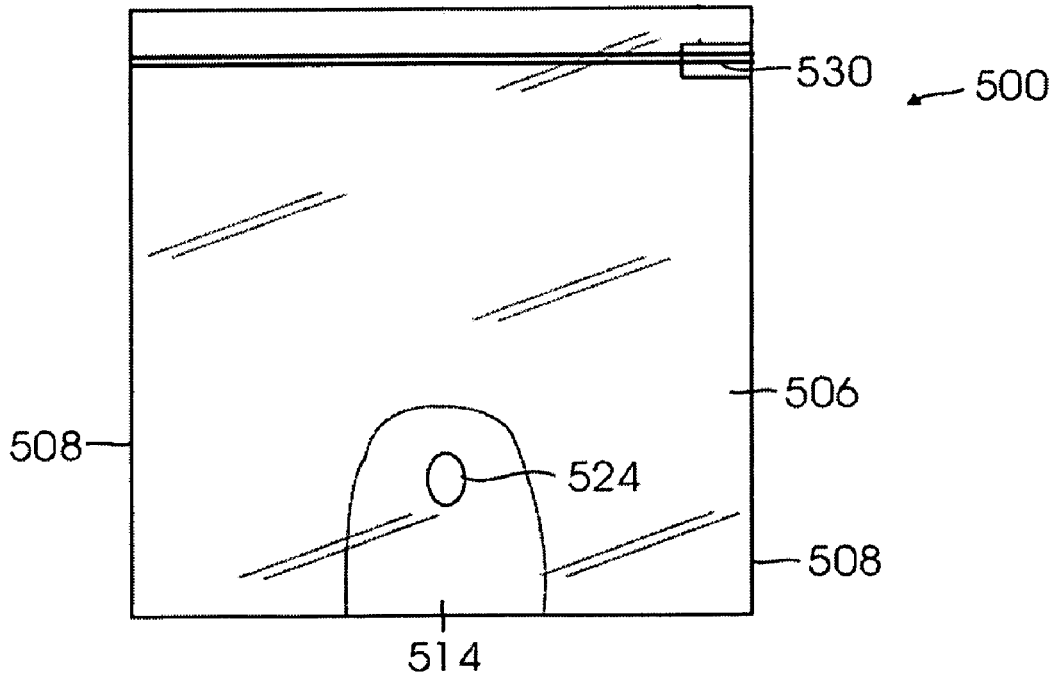
FIG. 6 illustrates a back view of the storage bag of FIG. 5.

FIGS. 5 and 6 illustrate front and back views of a storage bag 500, according to one embodiment of the present invention. The storage bag 500 includes a first flexible panel 502, having a first pair of side peripheral edges 504, a first top edge and a first bottom edge, superimposed on a second flexible panel 506, having a second pair of side peripheral edges 508, a second top edge and a second bottom edge, sealed together along the first and second side peripheral edges 504 and 508 creating an interior storage area. In one embodiment the flexible panels 502 and 506 may be heat-sealed together, or sealed together by any other method known in the art.

The storage bag 500 may further include a flexible inner liner, secured to the first and second bottom edges of the panels 502 and 506, and located within the interior storage area. The flexible inner liner may include a main portion 512 into which a user's hand may be inserted. The flexible inner liner may be contoured to the shape of a hand and include a plurality of extending members. The plurality of extending members may include a thumb portion 514, index finger portion 516, middle finger portion 518, ring finger portion 520 and little finger 522 which extend outwardly from the main portion 512 and are adapted to receive the thumb, index finger, middle finger, ring finger and little finger, respectively, of the user's hand in a conventional manner.

In one embodiment, the thumb portion 514 is secured to an inner side of the second flexible panel 506 and the index finger, middle finger, ring finger and little finger portions 516-522 may be secured to an inner side of the first flexible panel 506 by any method known in the art, such as a set of heat stamps 524. The set of heat stamps keep the extending members out of the way when items are placed in the interior storage area of the bag 500. However, once a user inserts his hand into the flexible inner liner of the bag 500, the set of heat stamps may be detached from the flexible side panels 504 and 508 to allow the user to pull the flexible panels 502 and 506 downwards so that the user may easily access the contents of the bag 500. The set of heat stamps 524 may be generally oval in shape. However, in alternative embodiments, the set heat stamps may be other shapes, such as circular, triangles, squares, or other polygons In one embodiment, the main portion 512 of the flexible inner liner may be secured to the flexible panels 504 and 506 by a heat print 526 to retain the flexible inner liner within the interior storage area when the user removes his hand. The flexible inner liner allows a user to easily pick up an object, such as food, without contaminating the object with dirty hands as the flexible inner liner acts as a barrier between the food and the hands of the user. The heat stamp 526 may be generally rectangular in shape. However, in alternative embodiments, the heat stamp may be other shapes, such as ovals, triangles, squares, or other polygons. The heat stamp may be used to attach the flexible inner liner to the first flexible panel 502 and/or the second flexible panel 506.

The storage bag 500 may include a plurality of connecting members 528 located between the finger portions 516-522. The plurality of connecting members 528 may be used to interconnect and strengthen the finger portions 516-522.

The bag 500 may include a closure member 530 for securing the first and second top edges of the first and second flexible panels 502 and 506 together to keep the objects in the bag 500. The closure member 530 may include interlocking male and female profile strips which may be secured near the top inner edges of the flexible panels 502 and 506. The male and female profile strips may be extruded separately and subsequently attached to the respective flexible panels 502 and 506 near the top edges or the male and female strips may be extruded integral with the flexible panels 502 and 506. The closure member 530 may be a sliding member adapted to facilitate closing and opening of the male and female profile strips or may be any other type of closure mechanism known in the art.

The storage bag 500 may also include a bottom or second closure member (not shown) for securing the first and second bottom edges of the first and second flexible panels 502 and 506 together to retain the entire inner liner in the interior storage area when not in use. When the user is ready to come into contact with the items in the bag 500, the user opens the bottom closure member creating an opening which allows the user to insert a hand into the inner liner. The fingers are inserted into the finger portions and the thumb is inserted into the thumb portion allowing the palm to rest in the main portion. Once the user's hand is inserted into the flexible inner liner, the user may grab the item in the bag and push or pull the flexible side panels down over the hand so the hand in the flexible inner liner and the items in the bag are exposed. If the item in the bag is food, the user may hold onto the food using the inner liner and eat the food without having to directly touch the food. This way, if the user's hands are dirty or contaminated, the food will not be contaminated.

Figure 7:
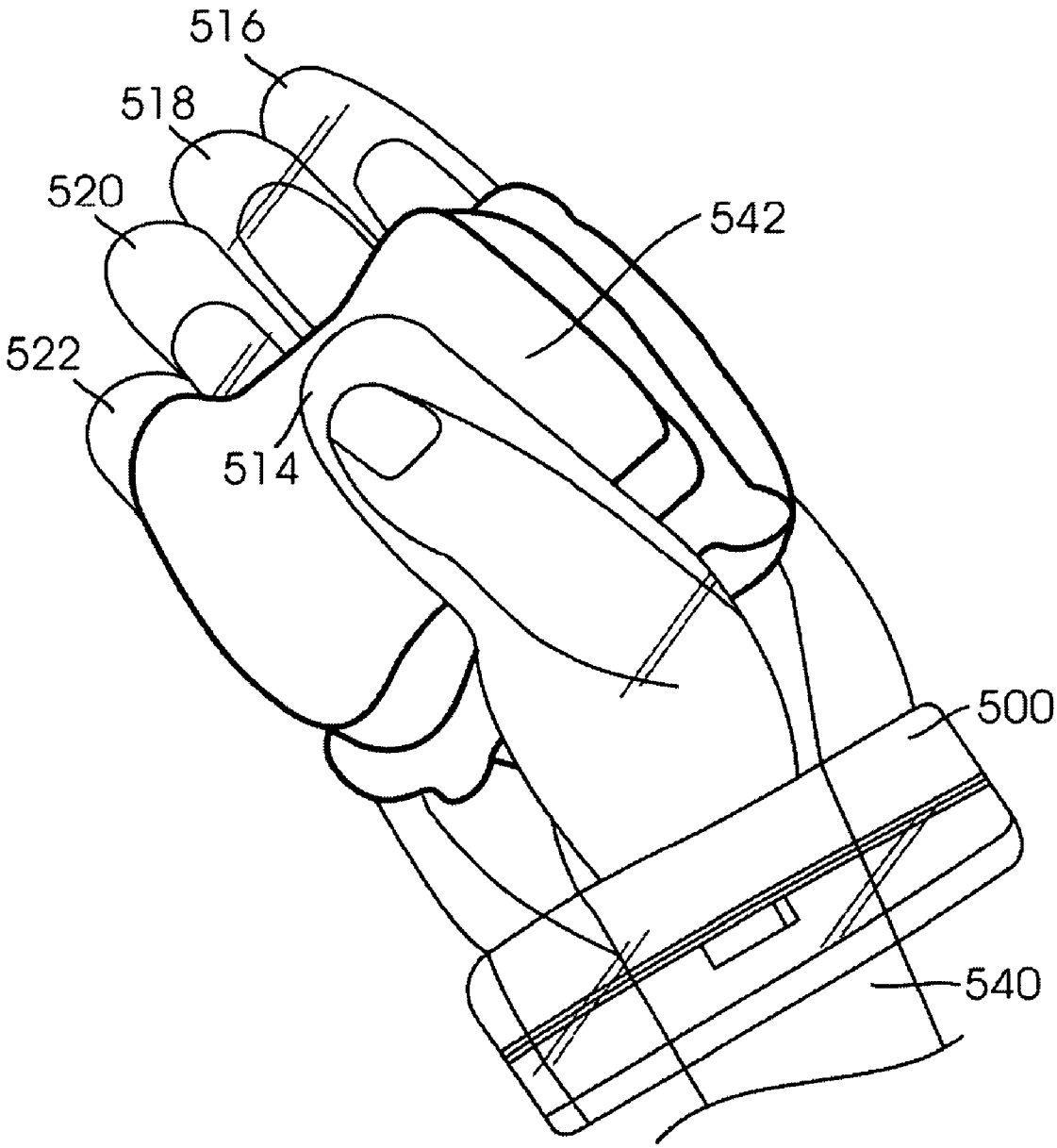
FIG. 7 illustrates the storage bag of FIG. 5 in an open and fully extended position on the hand of a user.
Figure 8:
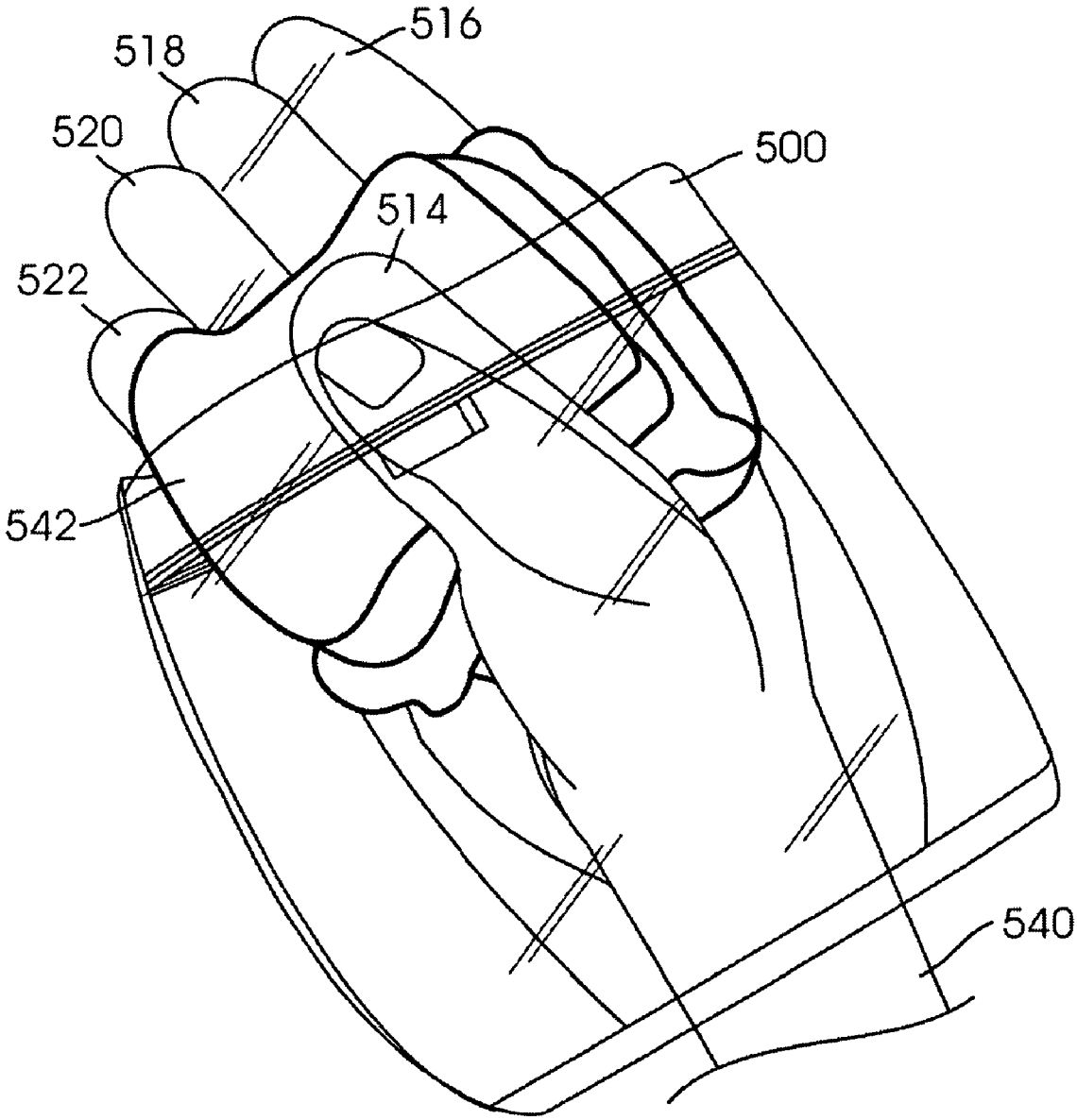
FIG. 8 illustrates the storage bag of FIG. 5 in an open and partially extended position on the hand of a user.

FIG. 7 illustrates the storage bag 500 of FIG. 5 in an open and fully extended position on the hand 540 of a user holding a food item 542, such as a sandwich. If the user does finish the food and would like to save it for later, the user only has to pull the flexible side panels upwards back up over his hand and reclose the storage bag 500 with the remainder of the food item still inside and having never touched the dirty hands of the user. As the food does not come into direct contact with the user's hand, it remains uncontaminated. FIG. 8 illustrates the bag 500 of FIG. 5 in an open and partially extended position on the hand 540 of the user.

Figure 9:
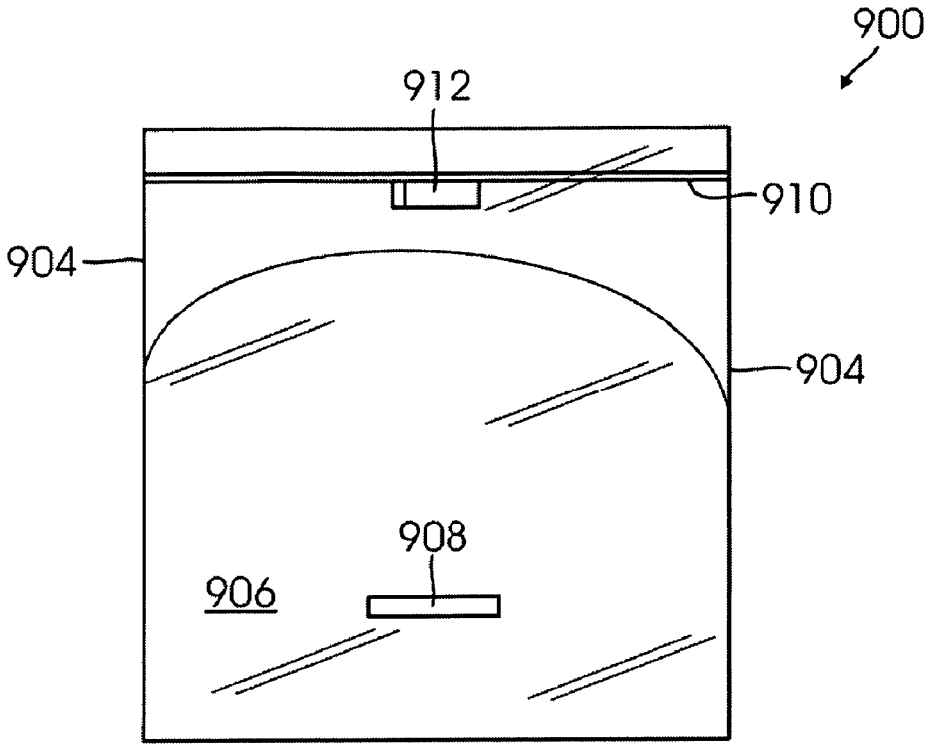
FIG. 9 illustrates a storage bag, according to one embodiment of the present invention.

FIG. 9 illustrates a storage bag 900 according to one embodiment of the present invention. The storage bag 900 may include a first flexible panel, having a first pair of side peripheral edges 904, a first top edge and a first bottom edge, superimposed on a second flexible panel (not shown), having a second pair of side peripheral edges, a second top edge and a second bottom edge, sealed together along the first and second side peripheral edges creating an interior storage area. In one embodiment the flexible panels may be heat-sealed together, or sealed together by any other method known in the art.

The storage bag 900 may include a flexible inner liner secured to the first and second bottom edges of the flexible panels, having a thumb portion (as shown in FIG. 2) and a "mitten shaped" main portion 906 for receiving a user's thumb and the user's four fingers, respectively.

In one embodiment, the thumb portion and the main portion 906 may be secured to the inner sides of the flexible panels by any method known in the art, such as a heat stamp 908. However, once a user inserts his hand into the flexible inner liner of the bag 900, the heat stamp 908 may be detached from the flexible side panels to allow the user to pull the flexible panels downwards so that the user may access the contents of the bag 900. The heat stamp 908 may be generally rectangular in shape. However, in alternative embodiments, the heat stamp may be other shapes, such as ovals, triangles, squares, or other polygons. The heat stamp 908 may be used to attach the flexible inner liner to the first flexible panel and/or the second flexible panel.

The bag 900 may include a closure member 910 for securing the first and second top edges of the first and second flexible panels together to keep objects in the bag 900. The closure member 910 may include interlocking male and female profile strips (not shown) which may be secured near the top inner edges of the flexible panels. The male and female profile strips may be extruded separately and subsequently attached to the respective flexible panels near the top edges or the male and female profile strips may be extruded integral with the flexible panels. The closure member 910 may be any type of closure mechanism known in the art.

The storage bag 900 may further include a pair of tabs 912 secured to the outer sides of the flexible panels, below the closure member 910, for assisting users who may have difficulty in opening the storage bag 900, such as users with arthritis. When a user pulls the tabs 912 in opposite directions, the closure member 910 of the storage bag 900 is opened allowing the user access to the interior storage area and its contents.

The storage bag 900 may also include a bottom or second closure member (not shown) for securing the first and second bottom edges of the first and second flexible panels together to retain the entire inner liner in the interior storage area. When the user is ready to come into contact with the items in the bag 900, the user opens the bottom closure member creating 910 an opening which allows the user to insert a hand into the inner liner. The fingers are inserted into the main portion and the thumb is inserted into the thumb portion. Once the user's hand is inserted into the flexible inner liner 906, the user may grab the item in the bag and push or pull the flexible side panels down over the hand so the hand in the flexible inner liner and the items in the bag are exposed. If the item in the bag is food, the user may hold onto the food using the inner liner and eat the food without having to directly touch the food. This way, if the user's hands are dirty or contaminated, the food will not be contaminated.

Figure 10:
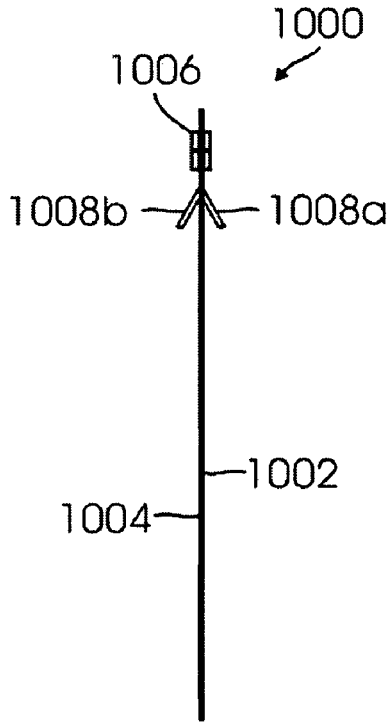
FIG. 10 illustrates a side view of a storage bag in a closed position.

FIG. 10 illustrates a side view of a storage bag 1000, according to one embodiment of the present invention. The storage bag 1000 may include a first flexible panel 1002, having a first pair of side peripheral edges, a first top edge and a first bottom edge, superimposed on a second flexible panel 1004, having a second pair of side peripheral edges, a second top edge and a second bottom edge, sealed together along the first and second side peripheral edges creating an interior storage area. In one embodiment the flexible panels may be heat-sealed together, or sealed together by any method known in the art.

The bag 1000 may include a closure member 1006 for securing the first and second top edges of the first and second flexible panels 1002 and 1004 together to keep the objects in the bag 1000. The closure member 1006 may include interlocking male and female profile strips (not shown) which may be secured near the top inner edges of the flexible panels 1002 and 1004. The male and female profile strips may be extruded separately and subsequently attached to the respective flexible panels 1002 and 1004 near the top edges or the male and female profile strips may be extruded integral with the flexible panels 1002 and 1004. The closure member 1006 may be a sliding member adapted to facilitate closing and opening of the male and female profile strips.

The storage bag 1000 may further include a pair of tabs 1008*a* and 1008*b* secured to the outer sides of the flexible panels 1002 and 1004, below the closure member 1006, for assisting users who may have difficulty in opening the storage bag 1000, such as users with arthritis. When a user pulls the tabs 1008*a* and 1008*b* in opposite directions, the closure member 1006 of the storage bag 1000 is opened allowing the user access to the interior storage area and its contents.

The storage bag 1000 may also include a bottom or second closure member (not shown) for securing the first and second bottom edges of the first and second flexible panels together to retain the entire inner liner in the interior storage area.

The storage bags described above may be made from any suitable material such as polyolefins (such as polyethylene, polypropylene, etc.), polyvinyl chloride, polyvinylidine, linear low density polyethylene and other linear plastics.

The storage bags may be utilized with equal efficacy with either the right hand or the left hand of a user.

While the storage bags are depicted as having a substantially rectangular configuration with respect to the front and rear views, it is to be understood that the teaching of the disclosure may be implemented with bags having alternative shapes including, but not limited to, square, circular, cylindrical, trapezoidal or any other polygonal shape.

One or more of the components and functions illustrated in FIGS. 1, 2, 3, 4, 5, 6, 7, 8, 9 and/or 10 may be rearranged and/or combined into a single component or embodied in several components without departing from the invention. Additional elements or components may also be added without departing from the invention.

While certain exemplary embodiments have been described and shown in the accompanying drawings, it is to be understood that such embodiments are merely illustrative of and not restrictive on the broad invention, and that this invention is not be limited to the specific constructions and arrangements shown and described, since various other modifications may occur to those ordinarily skilled in the art.

The invention claimed is:

1. A storage bag, comprising:

a first flexible panel, having a first pair of side peripheral edges, a first top edge and a first bottom edge;

a second flexible panel, having a second pair of side peripheral edges, a second top edge and a second bottom edge, superimposed on the first flexible panel and sealed together along the first and second side peripheral edges creating an interior storage area; and a flexible inner liner secured to the first and second bottom edges and removably located in the interior storage area; and wherein the flexible inner liner includes a main portion and a plurality of extending portions extending outwardly from the main portion, each extending member of the plurality of extending members detachably secured to an inner side of the first flexible panel or an inner side of the second flexible panel, wherein the plurality of extending members detached from the flexible side panels upon insertion of a hand of a user.

2. The storage bag of claim 1, further comprising a re-sealable pouch located within the interior storage area and secured to the first or second flexible panel.

3. The storage bag of claim 1, wherein the main portion is adapted for receiving a hand of a user and the plurality of extending portions are adapted to receive fingers of a user.

4. The storage bag of claim 1, wherein the plurality of extending portions are detachably secured using a heat stamp.

5. The storage bag of claim 1, wherein the plurality of extending portions are detached upon insertion of the hand of the user into the flexible inner liner.

6. The storage bag of claim 3, further comprising a plurality of connecting members located between the plurality of extending members.

7. The storage bag of claim 1, further comprising a top closure member having a male profile strip, proximate the first top edge, and a female profile strip, proximate the second top edge, adapted to interlock for securing the first and second top edges of the first and second flexible panels together.

8. The storage bag of claim 7, further comprising a pair of tabs secured proximate the first and second top edges of the first and second flexible panels for opening the closure member.

9. The storage bag of claim 7, wherein the closure member further includes a sliding member adapted to facilitate closing and opening of the male and female profile strips.

10. The storage bag of claim 1, further comprising a bottom closure member having a male profile strip, proximate the first bottom edge, and a female profile strip, proximate the second bottom edge, adapted to interlock for securing the first and second bottom edges of the first and second flexible panels together.

11. The storage bag of claim 1, wherein the flexible inner liner is in the shape of a mitten.

12. The storage bag of claim 1, wherein the re-sealable pouch comprises a single flexible sheet having four edges forming a square configuration, the single flexible sheet is fixedly secured to the first or second flexible panel at three of the four edges and wherein a fourth edge includes having a first profile strip extending a length of the fourth edge, the first profile strip adapted to interlock with a second profile strip secured to the first or second panel, the interlocking of the first and second profile strips forming a pouch closure member.

13. The storage bag of claim 12, wherein the first profile strip is a male strip and wherein the second profile strip is a female strip.

14. A storage bag, comprising:

a first flexible panel having a first pair of side peripheral edges, a first top edge and a first bottom edge;

a second flexible panel, having a second pair of side peripheral edges, a second top edge and a second bottom edge, superimposed on the first flexible panel and sealed together along the first and second side peripheral edges creating an interior storage area;

a top closure member having a male profile strip, proximate the first top edge, and a female profile strip, proximate the second top edge, adapted to interlock for securing the first and second top edges of the first and second flexible panels together;

a pair of tabs secured proximate the first and second top edges of the first and second flexible panels for opening the closure member; and a flexible inner liner secured to the first and second bottom edges and removably located in the interior storage area, the flexible inner liner comprising:

a main portion; and a plurality of extending portions extending outwardly from the main portion, each extending member of the plurality of extending members detachably secured to an inner side of the first flexible panel or an inner side of the second flexible panel, wherein the plurality of extending members detached from the flexible side panels upon insertion of a hand of a user.

15. The storage bag of claim 14, further comprising a bottom closure member having a male profile strip, proximate the first bottom edge, and a female profile strip, proximate the second bottom edge, adapted to interlock for securing the first and second bottom edges of the first and second flexible panels together.

16. The storage bag of claim 14, further comprising a plurality of connecting members located between the plurality of extending members.

17. The storage bag of claim 14, further comprising a pouch located within the interior storage area and secured to the first or second flexible panel.

18. A storage bag, comprising:

a first flexible panel having a first pair of side peripheral edges, a first top edge and a first bottom edge;

a second flexible panel, having a second pair of side peripheral edges, a second top edge and a second bottom edge, superimposed on the first flexible panel and sealed together along the first and second side peripheral edges creating an interior storage area; and a flexible inner liner secured to the first and second bottom edges and removably located in the interior storage area, the flexible inner liner comprising:

a main portion; and a plurality of extending portions extending outwardly from the main portion, each extending member of the plurality of extending members detachably secured to an inner side of the first flexible panel or an inner side of the second flexible panel, wherein the plurality of extending members detached from the flexible side panels upon insertion of a hand of a user; and a re-sealable pouch located within the interior storage area and secured to the first or second flexible panel.

19. The storage bag of claim 18, further comprising:

a top closure member having a first male profile strip, proximate the first top edge, and a first female profile strip, proximate the second top edge, adapted to interlock for securing the first and second top edges of the first and second flexible panels together; and a bottom closure member having a second male profile strip, proximate the first bottom edge, and a second female profile strip, proximate the second bottom edge, adapted to interlock for securing the first and second bottom edges of the first and second flexible panels together.

* * * * *